US005568859A

United States Patent [19]

Levy et al.

[11] Patent Number: 5,568,859

[45] Date of Patent: Oct. 29, 1996

[54] FOLDABLE FOOT SWITCH

[75] Inventors: Uri Levy, Rehovot; Ofer Braude, Ramat-Gan; Ytzhak Rozenberg, Tel-Aviv; Yotam Zimmerman, Hadera, all of Israel

[73] Assignee: Laser Industries, Limited, Tel Aviv, Israel

[21] Appl. No.: 512,387

[22] Filed: Aug. 8, 1995

[51] Int. Cl.[6] ..... H01H 3/14

[52] U.S. Cl. ..... 200/43.01; 200/86.5

[58] Field of Search ..... 200/43.01, 43.13, 200/43.16, 43.18, 43.22, 333, 86.5, 293, 345, 334, 304, 343; 220/4.02, 4.21, 422; 174/48, 35 R, 35 MS

[56] References Cited

U.S. PATENT DOCUMENTS

| | | | |
|---|---|---|---|
| 1,706,518 | 3/1929 | Blough | 200/86.5 |
| 3,970,984 | 7/1976 | Grubenmann | 338/153 |
| 4,172,217 | 10/1979 | Miller | 200/86.5 |
| 4,496,811 | 1/1985 | Irwin | 200/86.5 |
| 5,157,577 | 10/1992 | Balaud et al. | 200/43.22 |
| 5,166,513 | 11/1992 | Keenan et al. | 200/86.5 X |

FOREIGN PATENT DOCUMENTS

| | | | |
|---|---|---|---|
| 0657254 | 2/1963 | Canada | 200/86.5 |

*Primary Examiner*—Renee S. Luebke
*Attorney, Agent, or Firm*—Cobrin Gittes & Samuel

[57] ABSTRACT

A foot switch for systems such as laser surgery systems. The foot switch utilizes a base, a signal generator connected to the base and a cover rotatably connected to the base in such a way that the cover can be rotated from a first closed position to a second open position. Thus the foot switch is compact and light weight.

15 Claims, 3 Drawing Sheets

FOLDABLE FOOT SWITCH

BACKGROUND OF THE INVENTION

This invention relates generally to a foot switch for instrumentation and more particularly to a foot switch control for laser surgery systems.

A trend in medical laser surgery systems as well as in many non-laser systems and nonmedical systems is the minimization of the size of these systems. In particular, laser surgery systems based on laser diode technology are becoming more light weight and compact. These systems and many others are activated by a foot switch. Presently, foot switches are generally larger and bulkier than they need to be.

Thus there exists the need for a foot switch that is light weight and compact in size.

It is accordingly an object of the invention to provide a foot switch that is compact in size.

It is another object of the invention to provide a foot switch that may be opened to full size during operation but is foldable to be compact for storage or transportation.

It is a further object of the invention to provide a compact foot switch that operates a laser.

It is still another object of the present invention to provide a foot switch that is water tight.

SUMMARY OF THE INVENTION

The foregoing objects are attained by the present invention, which provides a foldable foot switch which may operate a laser system. The invention utilizes a base, a signal generator connected to the base and a cover rotatably connected to the base in such a way that the cover can be rotated between a first closed position and a second open position.

The invention will next be described in connection with certain illustrated embodiments; however, it should be clear to those skilled in the art that various modifications, additions and subtractions can be made without departing from the spirit or scope of the claims.

BRIEF DESCRIPTION OF THE DRAWINGS

For a fuller understanding of the nature and objects of the invention, reference should be made to the following detailed description and accompanying drawings, in which.

DESCRIPTION OF ILLUSTRATED EMBODIMENTS

Figure 1:
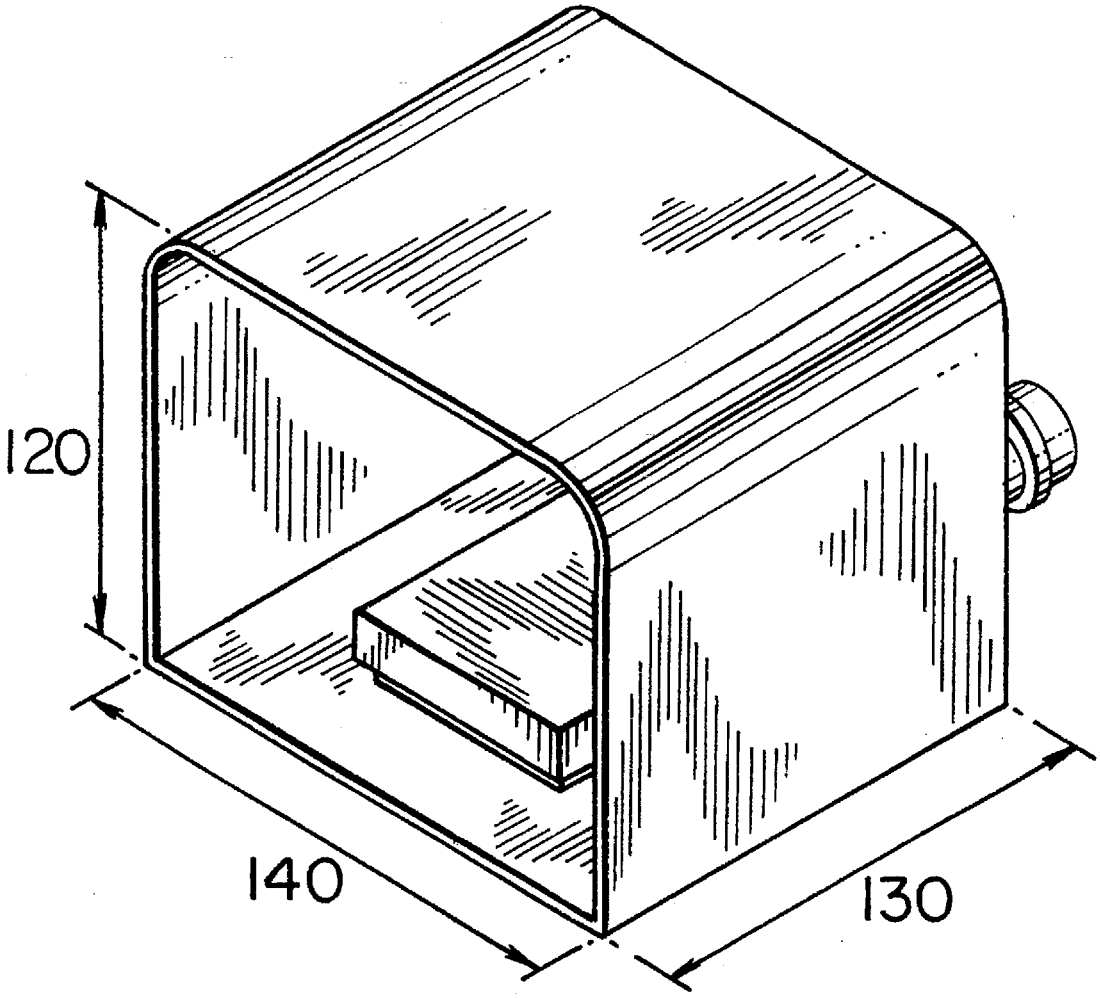
FIG. 1 PRIOR ART
FIG. 1 depicts a perspective view of a foot switch typical of the prior art.
Figure 1A:
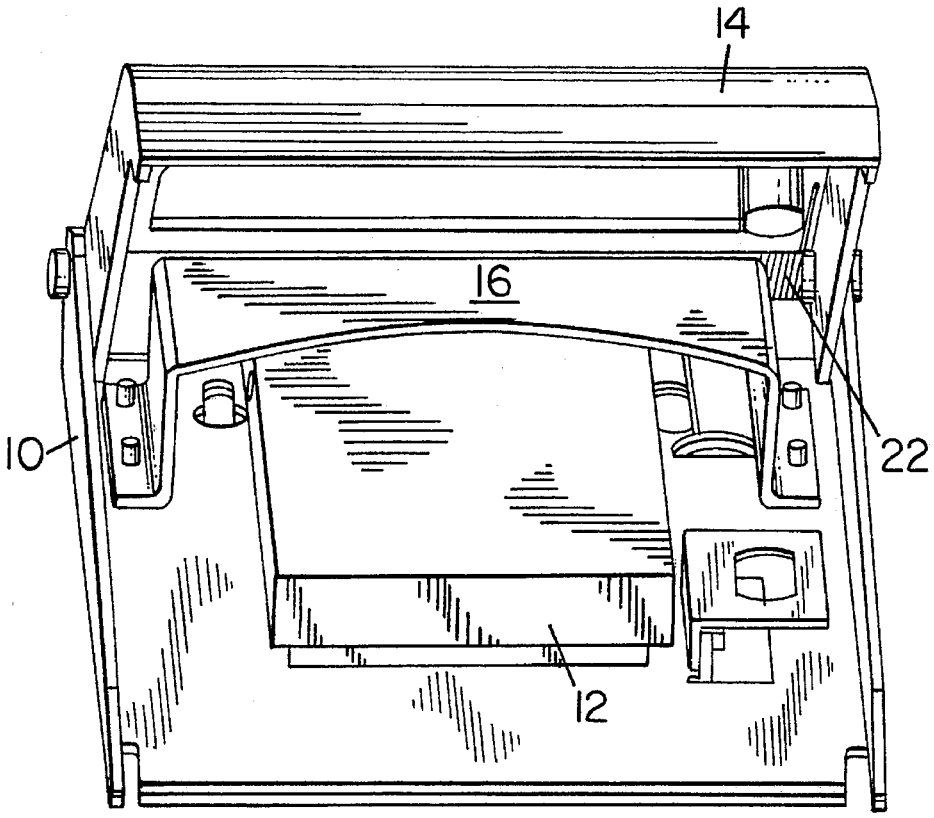
FIG. 1A depicts a perspective view of a foot switch in accordance with the present invention.
Figure 2:
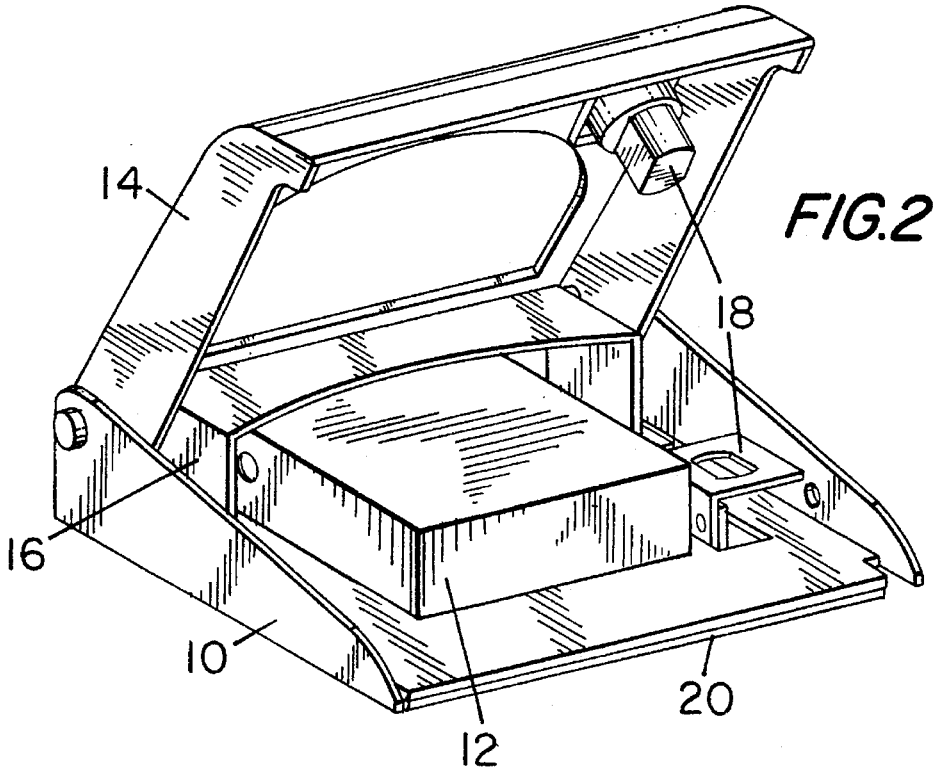
FIG. 2 depicts a perspective view of the foot switch depicted in FIG. 1A showing details of a push-release latch.

The overall configuration of the present invention is depicted in FIGS. 1A and 2. The invention is directed to a foot switch for controlling a laser.

FIGS. 1A and 2 depict the present invention which overcomes the problem of miniaturizing a laser system by including a foot switch having a base 10, a signal generator

12 connected to the base 10 and a cover 14 that is rotatably connected to the base 10. The cover 14 can be selectively rotated between a first closed position and a second open position. When the cover 14 is in the first closed position the cover 14 and the base 10 surround the signal generator 12. When the cover 14 is in the second open position the signal generator 12 is easily accessible for use. When the cover is in the first closed position the foot switch is compact and easily stored. Thus the operator may close the cover during a break in an operation to prevent accidentally activating the system.

Figure 3:
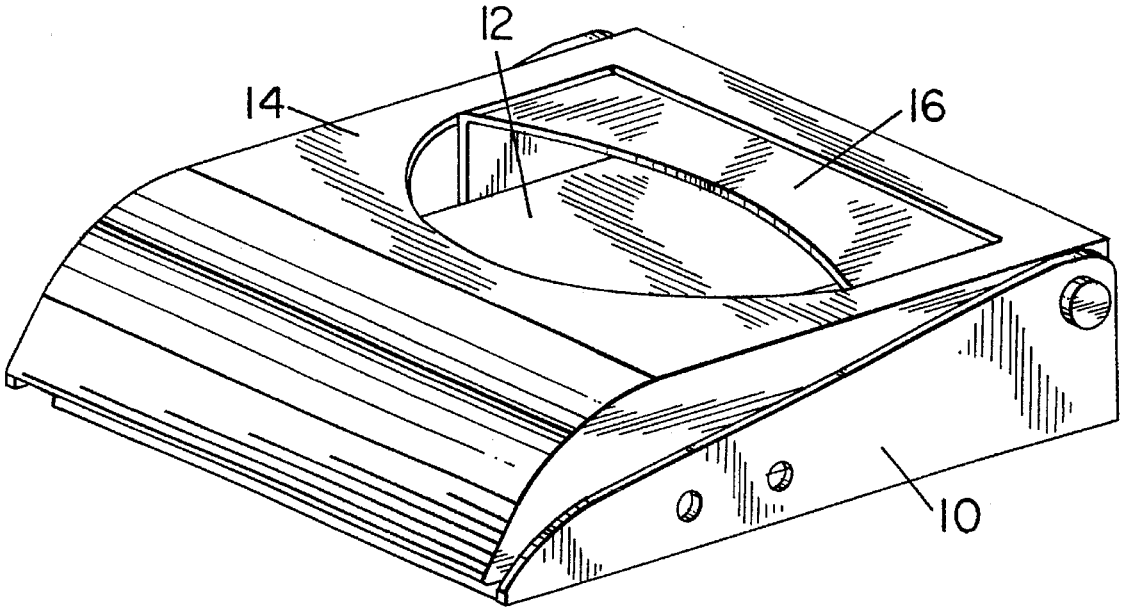
FIG. 3 depicts a perspective view of the foot switch depicted in FIG. 1A with the cover in a closed position.

As illustrated in FIGS. 1–3, the cover 14 may have an aperture to decrease the weight of the foot switch, to make it easier for the operator to insert his/her shoe into the device when the cover is in the second open position and to allow the foot switch to be lifted and moved with the toe portion of an operator's shoe. It will be apparent that the foot switch will still be compact and light weight even if the cover 14 has no aperture. In the preferred embodiment, the aperture is arcuate and may be situated in the cover 14 such that when the cover 14 is in its second open position, the aperture is located above the signal generator 12 and an operator could lift and move the foot switch by inserting the toe of his/her shoe through the aperture, lifting the foot switch and moving the foot switch to a desired position. It will be apparent to those skilled in the art that the aperture could have many different configurations such as multiple small apertures, circular apertures square apertures or the like and need not enable an operator to move the foot switch via the aperture.

The foot switch may further include a bridge 16 that is connected to the base 10, on opposite sides of the signal generator 12, and covers a portion of the signal generator 12 such that when the cover 14 is in the first closed position and the aperture in the cover is located above the signal generator 12, the bridge 16 further prevents the operator or another person or an object such as the wheel from a cart from accidentally operating the signal generator 12. It will be apparent to one skilled in the art that instead of including the bridge 16, the aperture in the cover 14 could be made smaller to have the same effect as the bridge 16 (further protecting the signal generator 12 and further preventing accidental operation of the switch when the cover 14 is in the first closed position).

Another aspect of the foot switch is the clasp 18. In the preferred embodiment, the clasp 18 comprises a push-release latch 18 such as a push release latch manufactured by Southco, Inc. The push release latch 18 is a double click latch 18 such that it is locked by pressing it once and released by pressing it a second time. It will be apparent to one skilled in the art that almost any type of latching mechanism will be suitable so long as it enables the operator to selectively fasten the cover 14 in the first closed position and then selectively release it so that the cover 14 may be moved to the second open position. In the preferred embodiment, the clasp 18 includes a spring (not shown). The push-release latch may be configured wherein one portion (the keeper) of the latch is connected to the base 10 and the other portion (the latch) is connected to the cover 14 (as depicted in FIG. 2) or visa versa.

Another aspect of the invention is a non-slip material 20 connected to the bottom of the base 10 to prevent the foot switch from sliding. The non-slip material 20 may be rubber, VELCRO™, cloth, felt, sponge, plastic or any other suitable material that will prevent slippage. This non-slip material 20 could be the same size as the base 10 or it could be smaller than the base 10 or it could even be larger than the base 10 if necessary. It could also be a number of different pieces connected to different parts of the base (i.e. four small pieces of material one each corner of the base).

Yet another aspect of the invention is an urging member 22 that may be coupled between the cover 14 and the base 10 which urges the cover 14 towards the second open position. In the preferred embodiment this urging member 22 may be a spring.

The signal generator 12 is a water tight assembly that contains one or more switching mechanism(s) located within the signal generator 12 that signal to the system that the operator wishes to change the present state of the system (i.e. from ready to lazing, from flow current to stop flow current or from rotating to stop rotating etc.). These mechanisms may be microswitches that are well known in the art, thus they will not be described herein.

Figure 4:
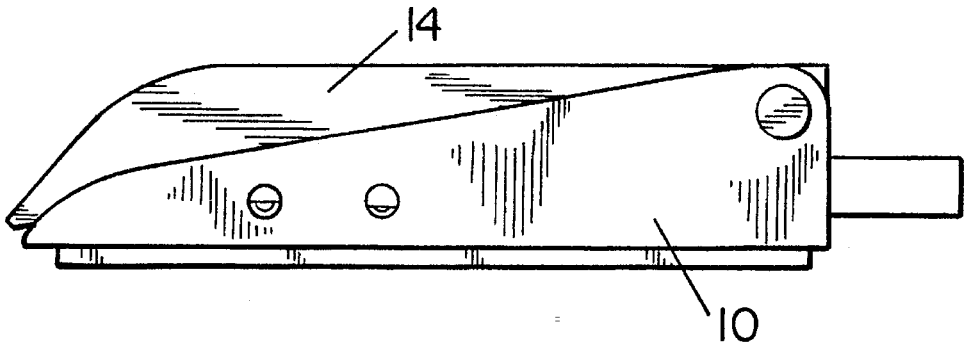
FIG. 4 depicts a side view of the foot switch depicted in FIG. 3.

The foot switch may communicate with the system either through conventional wires as depicted in FIG. 4, optical cable, air pressure, or it could be remote control using infrared, RF, or the like.

While the size of the foot switch may vary, in the preferred embodiment the foot switch looking at it from a front view is substantially 126 mm wide by 129 mm deep and with the cover 14 in its second open position the foot switch is substantially 110 mm high. Each of these numbers may be varied without departing from the scope of the invention. Further, while in the preferred embodiment the second open position of the cover 14 appears to be at substantially a 60 degree angle to the base 10, this second open position could effectively be anywhere from 180 degree angle to the base to a smaller angle than 60 degrees to the base 10 and the foot switch would still operate in accordance with the present invention. However, due to a medical regulation, if the foot switch is to be utilized in medical systems then the angle must be less than 90 degrees.

It will thus be seen that the invention efficiently attains the objects set forth above, among those made apparent from the preceding description. In particular, the invention provides a compact light weight foot switch for controlling systems such as laser surgery systems.

It will be understood that changes may be made in the above construction and in the foregoing sequences of operation without departing from the scope of the invention. It is accordingly intended that all matter contained in the above description or shown in the accompanying drawings be interpreted as illustrative rather than in a limiting sense.

It is also to be understood that the following claims are intended to cover all of the generic and specific features of the invention as described herein, and all statements of the scope of the invention which, as a matter of language, might be said to fall therebetween.

Having described the invention, what is claimed as new and secured by Letters Patent is:

What is claimed is:

1. A foot switch comprising:

a base;

a foot actuated signal generator coupled to said base and operative to generate signals in response to foot actuation;

a cover pivotally connected to said base to rotate between an open position that permits access to said foot actuated signal generator from between said cover and said base and a closed position that blocks access to said foot actuated signal generator from between said cover and said base; and sidewalls interposed between said cover and said base and arranged to prevent said cover from reaching said foot actuated signal generator in a manner that would actuate said foot actuated signal generator as said cover rotates from said open position into said closed position, said foot actuated signal generator being situated between said sidewalls while said cover is in said closed position and being free of actuation from said cover.

2. The foot switch in accordance with claim 1 further comprising an urging member coupled between said cover and said base, said urging member continually urging said cover towards said position.

3. The foot switch in accordance with claim 1 wherein said signal generator is sealed so that no water can get within said signal generator.

4. The foot switch in accordance with claim 1 further comprising a latch for locking said cover to said base when said cover is in said closed position.

5. The foot switch in accordance with claim 4 wherein said latch comprises a spring loaded push-release latch.

6. The foot switch in accordance with claim 1 further comprising a non-slip material coupled to said base, wherein said non-slip material prevents said base from sliding when in use.

7. The foot switch in accordance with claim 6 wherein the non-slip material is a material selected from the group of materials including rubber, VELCRO™, cloth, felt, sponge and plastic.

8. A foot switch as in claim 1, further comprising a bridge coupled between said signal generator and said cover, said bridge resisting accidental operation of the foot actuated signal generator as the cover rotates into said closed position.

9. A foot switch as in claim 8, wherein said cover has an aperture situated over said bridge as said cover rotates into said closed position, said bridge covering a portion of said foot actuated signal generator.

10. A foot switch as in claim 1, wherein said sidewalls extend from said cover toward said base.

11. A foot switch as in claim 10, further comprising further sidewalls extending from said base, said foot actuated signal generator being situated between said further sidewalls.

12. A foot switch as in claim 1, wherein said cover has an aperture situated over a portion of said foot actuated signal generator.

13. A method of operating a medical apparatus, comprising the steps of:

(a) providing a foot switch, which comprises:

a base;

a foot actuated signal generator coupled to said base operative to generate signals in response to foot actuation;

a cover pivotally connected to said base to rotate between an open position that permits access to said foot actuated signal generator from between said cover and said base and a closed position that blocks access to said foot actuated signal generator from between said cover and said base; and sidewalls interposed between said cover and said base and arranged to prevent said cover from reaching said foot actuated signal generator in a manner that would actuate said foot actuated signal generator as said cover rotates from said open position into said closed position, said foot actuated signal generator being situated between said sidewalls while said cover is in said closed position and being free of actuation from said cover; and (b) signalling to a medical apparatus in response to activation of the foot actuated signal generator with a foot.

14. A method as in claim 13, wherein the cover has an aperture, further comprising the steps of inserting a toe of the shoe through the aperture, lifting the foot switch and moving the foot switch to a desired location.

15. A method as in claim 13, further comprising the step of blocking access to said foot actuated signal generator from a sideways direction as said cover is rotated into said open position, said blocking arising from further sidewalls extending from said base, said foot actuated signal generator being between said further sidewalls.

* * * * *